US007983592B2

(12) United States Patent
Naito et al.

(10) Patent No.: US 7,983,592 B2
(45) Date of Patent: Jul. 19, 2011

(54) TONER CONTAINER HAVING A SEALED TONER CAP

(75) Inventors: Kiyotaka Naito, Tokyo (JP); Yoshihiko Toyoizumi, Tokyo (JP); Tatsuo Nakanishi, Kanagawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 165 days.

(21) Appl. No.: 12/433,967

(22) Filed: May 1, 2009

(65) Prior Publication Data

US 2009/0279916 A1 Nov. 12, 2009

(30) Foreign Application Priority Data

May 7, 2008 (JP) ..... 2008-121022

(51) Int. Cl.
*G03G 15/08* (2006.01)

(52) U.S. Cl. ..... 399/106; 399/102; 399/120; 399/262

(58) Field of Classification Search ..... 399/102, 399/106, 120, 262
See application file for complete search history.

(56) References Cited

U.S. PATENT DOCUMENTS

| | | | | |
|---|---|---|---|---|
| 5,848,516 | A * | 12/1998 | Ban | 53/453 |
| 6,298,208 | B1 * | 10/2001 | Kawamura et al. | 399/262 |
| 6,336,020 | B1 * | 1/2002 | Ishikawa et al. | 399/262 |
| 2004/0091287 | A1 * | 5/2004 | Matsumoto et al. | 399/258 |
| 2005/0287456 | A1 * | 12/2005 | Tamura | 430/106.1 |

FOREIGN PATENT DOCUMENTS

| | | |
|---|---|---|
| JP | 3628539 | 12/2004 |

* cited by examiner

*Primary Examiner* — Ryan D Walsh
(74) *Attorney, Agent, or Firm* — Lucas & Mercanti, LLP

(57) ABSTRACT

A toner container for replenishing toner to an image forming apparatus including: a container main body which comprises a toner storage section and a toner outlet; a cap that covers the toner outlet; and a seal member that is interposed between the container main body and the cap to prevent toner leakage, wherein the container main body has a step portion formed between the toner storage section and the toner outlet, and the seal member is fixed on the step portion to be interposed between the step portion and the cap.

8 Claims, 4 Drawing Sheets

TONER CONTAINER HAVING A SEALED TONER CAP

CROSS REFERENCE TO RELATED APPLICATION

The present application is based on Japanese Patent Application No. 2008-121022 filed with Japanese Patent Office on May 7, 2008, the entire content of which is hereby incorporated by reference.

BACKGROUND OF THE INVENTION

1. Technical Field

The present invention relates to an improvement of a toner container, and in particular, to a toner container that is used for an image forming apparatus of an electrophotographic system and is installed in the image forming apparatus.

2. Description of Prior Art

In the image forming apparatus of an electrophotographic system, there is widely employed a toner replenishing method wherein a toner container storing toner is installed in the image forming apparatus, and toner is supplied bit by bit to the image forming apparatus from the toner container in the course of operations of the image forming apparatus.

A toner container used in the toner replenishing method of this kind is figured out so that a toner outlet of the toner container may be opened when the toner container is in an image forming apparatus, and the toner outlet may be closed when the toner container is taken out of the image forming apparatus.

The toner container is required not to leak toner when the toner container is conveyed with toner stored in the toner container and when, the toner replenishment is in execution under the condition that the toner container is installed in the image forming apparatus.

To satisfy the required function of this kind, a space between a main body of the toner container and a cap that closes a toner outlet on the toner container main body is sealed with a sealing member, in Japanese Registration Patent No. 3628539 (Patent Document 1).

FIG. 1 shows a schematic structure of a toner container disclosed in Patent Document 1.

Cap 20 is connected to a toner outlet of a cylindrical toner container main body 10, and seal member 60 is interposed between an end portion that forms an outlet of the toner container main body 10 and an end portion of the cap 20, to prevent toner leakage.

In the case of a toner container in Patent Document 1, seal member 60 is interposed between an end portion of toner container main body 10 and an end portion of a cap.

For preventing toner leakage, it is necessary to ensure that toner is not accumulated on a part of seal member 60.

For this purpose, an internal circumferential surface of the seal member 60 needs to be aligned with, or to be protruded from an internal circumferential surface of an end portion of the container main body, as illustrated.

In the case of this structure, toner is stemmed by the seal member, to be accumulated in the vicinity of the seal member, and toner ejection from the toner container main body 10 is disturbed.

Accurate toner replenishment is sometimes disturbed by this toner accumulation phenomenon.

SUMMARY

An objective of the invention is to solve the problems mentioned above.

A toner container reflecting one aspect of the present invention to solve the above mentioned problems is the toner container for replenishing toner to an image forming apparatus which includes:

a container main body which comprises a toner storage section and a toner outlet;

a cap that covers the toner outlet; and a seal member that is interposed between the container main body and the cap to prevent toner leakage, wherein the container main body has a step portion formed between the toner storage section and the toner outlet, and the seal member is fixed on the step portion to be interposed between the step portion and the cap.

BRIEF DESCRIPTION OF THE DRAWINGS

These and other objects, advantages and features of the invention will become apparent from the following description thereof taken in conjunction with the accompanying drawings in which:

FIG. 2(*b*) is a side elevation of a toner container relating to the embodiment of the invention;

DETAILED DESCRIPTION OF THE PREFERRED EMBODIMENT

The invention will be explained as follows based on the embodiment, to which, however, the invention is not limited.

Figure 2:
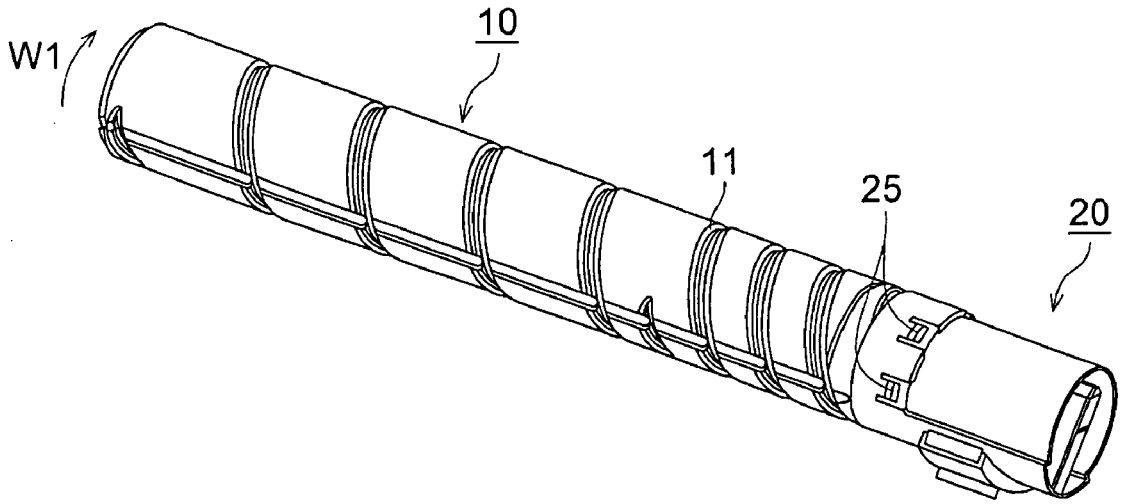
FIG. 2(*a*) is an appearance perspective view of a toner container relating to the embodiment of the invention.
Figure 2:
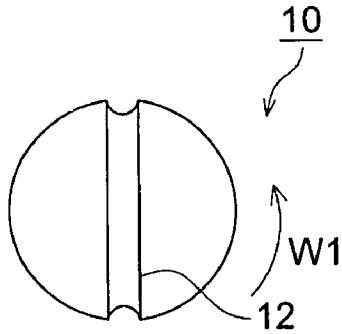

FIG. 2 includes an appearance perspective view and a side elevation of a toner container relating to the embodiment of the invention.

A toner container has cylindrical container main body 10 and cap 20.

The toner container is installed on an image forming apparatus (not shown), and container main body 10 is rotated as shown with arrow W1 when toner is replenished.

Toner in container main body 10 is sent in the direction to cap 20 by propulsion actions of spiral projection 11 in the case of rotation in the direction of W1, and is ejected from an outlet (which will be explained later) provided on cap 20.

On the right end in FIG. 2(*a*) for container main body 10, there is formed a toner outlet which is not shown, and a cylindrical portion where projection 11 of container main body 10 is formed is a toner storage portion.

A rotation of container main body 10 shown with arrow W1 is made by a drive member (not shown) of an image forming apparatus that is engaged with groove 12 shown in FIG. 2(*b*).

Meanwhile, projection 11 and groove 12 are formed to be in a form of a groove as external appearance of the toner container, but projection 11 is protruded on the inside wall of container main body 10, and it functions as a projection for conveying toner, while groove 12 functions as a groove to accept a drive member.

Cap 20 seals toner stored in container main body 10, and is a member to eject toner that is ejected from container main body 10 to a developing unit of an image forming apparatus.

It is made of plastic and is made up through injection molding. Cap 20 does not rotate in the course of toner replenishment.

Figure 3:
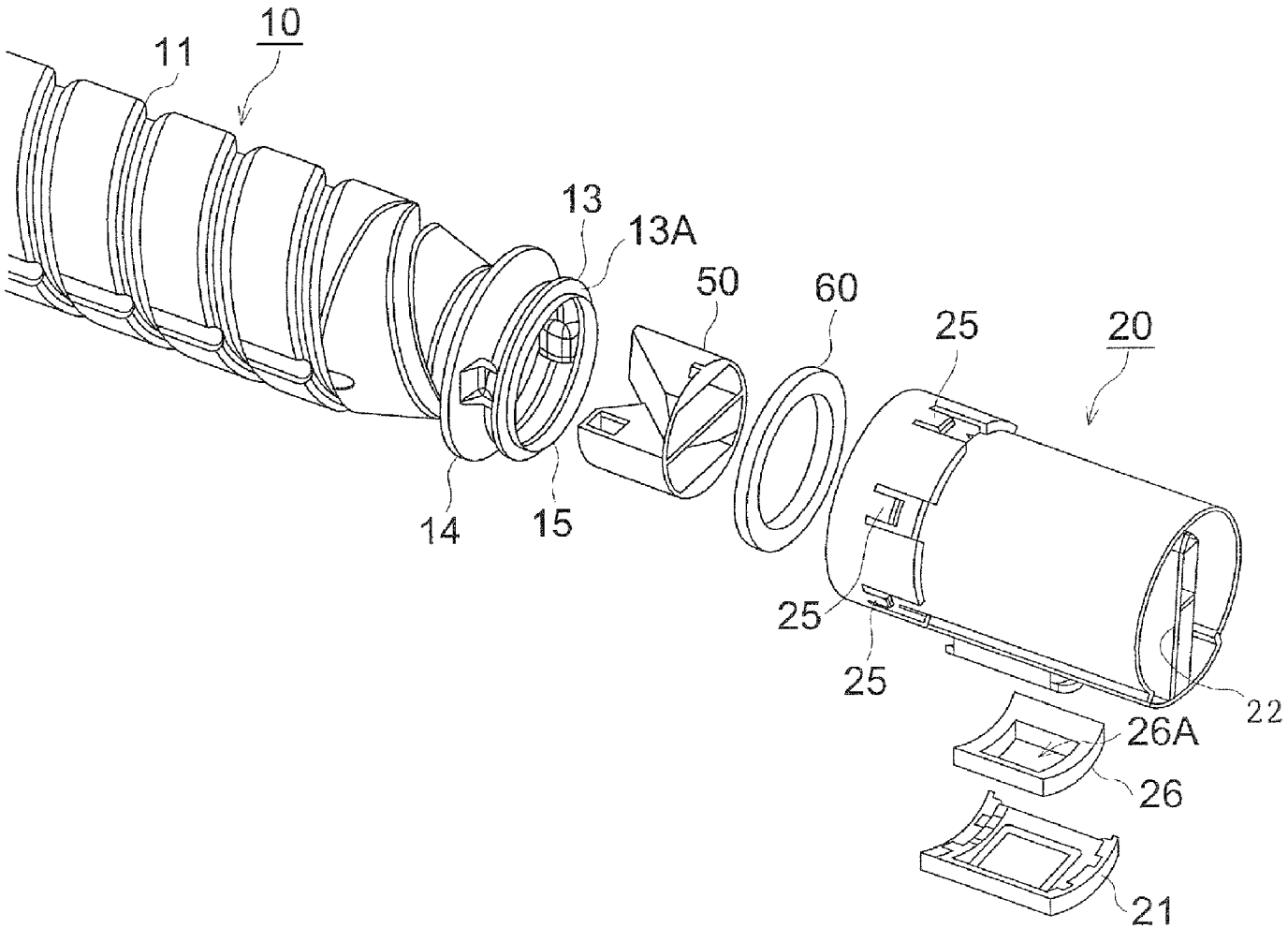
FIG. 3 is an exploded perspective view of a toner container shown in FIG. 2.

FIG. 3 is an exploded perspective view of a toner container shown in FIG. 2.

A toner container has container main body 10, toner guide member 50, cap 20 and seal member 60. The seal member 60 adheres to container main body 10 and is fixed thereon.

Items to rotate in the course of toner replenishment are container main body 10, toner guide member 50 and seal member 60, while cap 20 does not rotate.

Figure 4:
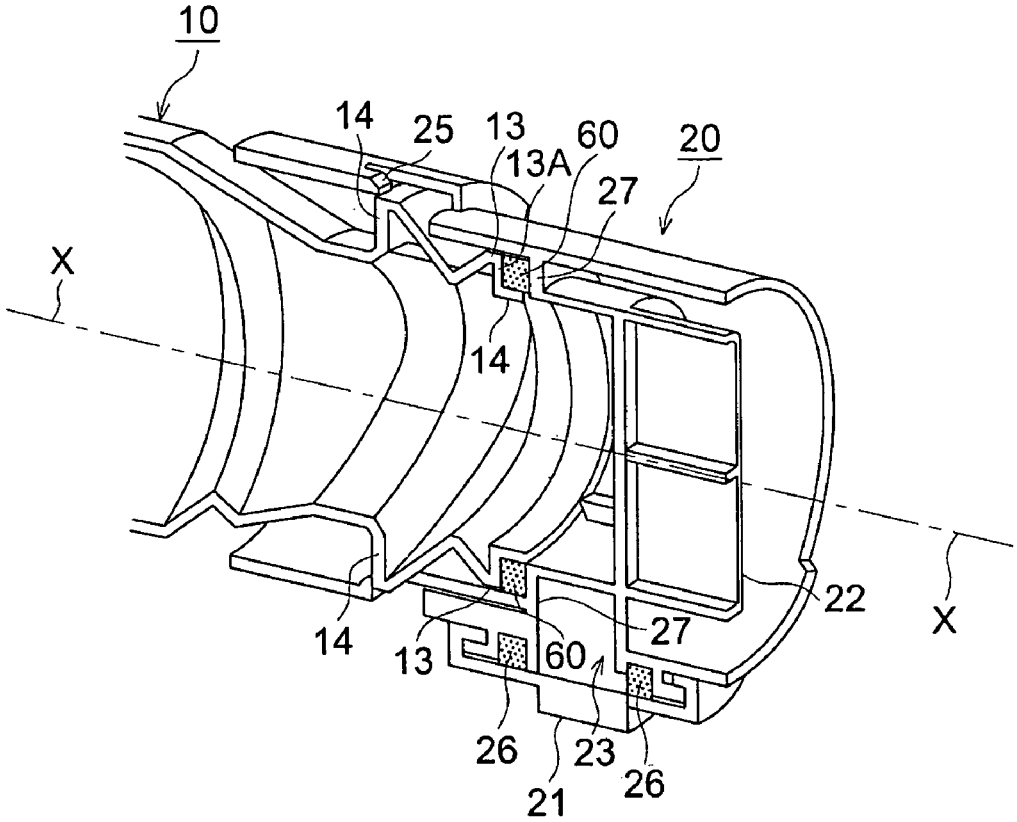
FIG. 4 is a cross-sectional view of a toner container relating to the embodiment of the invention.

FIG. 4 is a cross-sectional view of a toner container built up with cap 20 mounted on container main body 10.

On the outlet portion on the ejection side of container main body 10, there is formed ring-shaped step portion 13 having surface 13A perpendicular to rotation axis X.

Container main body 10 is made of plastic. Though the container main body 10 that is made through blow molding is preferable from the viewpoint of manufacturing cost, it is also possible to make container main body 10 through injection molding.

An end face of a toner outlet of container main body 10 which is made through blow molding is formed through cutting processing after molding.

Meanwhile, the step portion 13 that comes in contact with seal member 60 is molded by a metallic mold even when it is made through blow molding. Therefore, high accuracy for the step portion 13 can be obtained on the points of surface accuracy on the step and of positional accuracy on the step.

On an end portion of cap 20 on the left side in FIG. 3, there are formed plural engagement claws 25 on the circumference of the cap 20 at regular intervals.

A tip of the engagement claws 25 hits step portion 14 of container main body 10 as shown in FIG. 4. This hitting causes the cap 20 to be fixed so that the cap 20 may not move in the direction of rotational axis X from the container main body 10.

Further, this hitting causes the container main body 10 and the cap 20 to be combined in a way to be capable of rotating relatively.

The cap 20 has wall 27 that faces step portion 13 of the container main body 10.

The wall 27 is perpendicular to the rotational axis X as illustrated, and seal member 60 is interposed between face 13A of the step portion 13 and the wall 27. The face 13A of the step portion 13 with which the seal member 60 comes in contact is perpendicular to the rotational axis X in the illustrated example. However, the face 13A does not always need to be perpendicular to the rotational axis X, provided that the face 13A is a surface that intersect the rotational axis X.

The numeral 21 represents a shutter that opens and closes toner ejection section 23 of cap 20, and it is attached on the cap 20 to be capable of sliding in the rotational direction for the toner ejection section 23 of the cap 20, as shown in FIG. 3.

Seal member 60 is fixed on face 13A of the step portion 13 that is provided on container main body 10.

When no toner is loaded in an image forming apparatus and when a container for toner is installed in an image forming apparatus, the toner ejection section 23 is closed by the shutter 21.

The cap 20 has knob 22.

Under the condition that a toner container is installed in an image forming apparatus, the shutter 21 is fixed on the image forming apparatus.

When an operator operates the knob 22 to rotate the cap 20, the cap 20 rotates relatively to the shutter 21, thus, the shutter 21 opens the toner ejection section 23.

Namely, when a toner container is installed on the image forming apparatus and knob 22 is rotated, there comes a situation where toner can be replenished from the toner ejection section 23.

The numeral 26 represents a seal member that prevents that toner leaks out of the toner ejection section 23. On the seal member 26, there is formed toner outlet 26A that forms the outlet of toner from the toner ejection section 23, as shown in FIG. 3.

In the toner container explained above, toner leakage is prevented by causing seal member 60 to be interposed between container main body 10 representing a member rotating in toner replenishing operations and the cap 20 representing a member that does not rotate.

The seal member 60 is arranged between face 13A of the step portion 13 that is made by a metallic mold and wall 27 of a cap member.

Both face 13A and wall 27 are those molded by a metallic mold in the molding process, and they are formed at high accuracy in terms of a position and an angle accordingly.

When container main body 10 is one made through blow molding, an end face of the container main body 10 is formed by cutting processing.

However, accuracy of the face formed by cutting processing is not high relatively on the points of positional accuracy and flatness.

Figure 1:
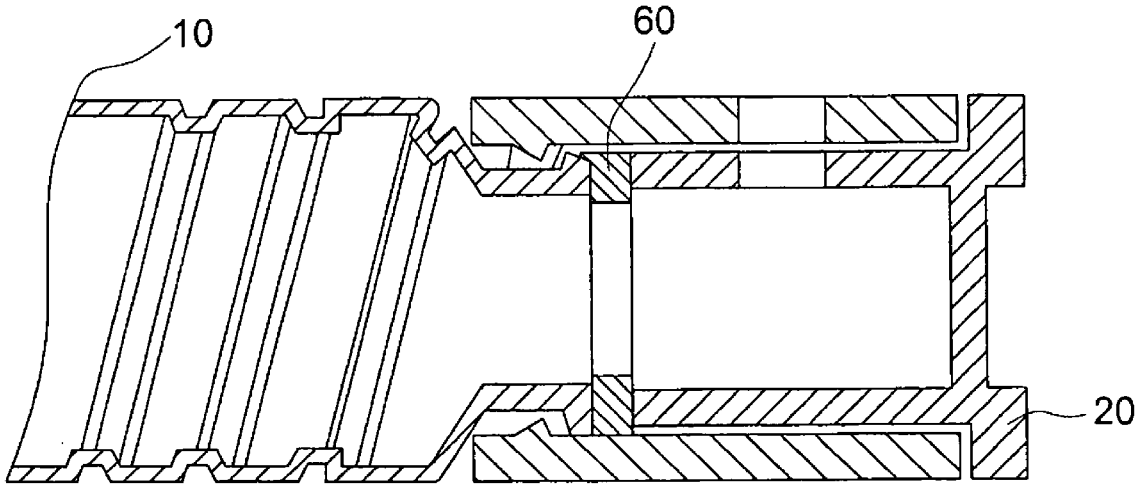
FIG. 1 PRIOR ART
FIG. 1 is a diagram showing a toner container in the prior art.

Therefore, when the seal member 60 is caused to be interposed between both end faces as shown in FIG. 1, for example, sealing is not sufficient because accuracy on the end face is low. Thereby, there exist problems such as occurrence of toner leakage and rapid advancement of deterioration of seal member.

As explained earlier, when the seal member 60 is caused to be interposed between step portion 13 and wall 27, sealing function is improved, and toner leakage is prevented sufficiently.

Further, in addition to high sealing functions being attained, fluctuations in drive force for driving container main body 10 are less when container main body 10 and cap 20 rotate relatively each other in toner replenishing operations.

Further, seal member 60 is glued on step portion 13 of container main body 10, and seal member 60 rubs on wall 27 in the case of toner replenishment, thereby, a rotation of the container main body is stabilized.

As toner to be stored in a toner container, a small-particle-size toner having a volume average particle size of 3-9 μm is preferable.

Even in the case of such small-particle-size toner, toner leakage can be prevented sufficiently by the toner container explained earlier, namely, the toner container wherein seal member 60 is caused to be interposed between step portion 13 provided on a container main body and wall 27 provided on cap 20.

Toner of the invention can contain, in addition to toner particles forming an image, fluidity improvers and a small amount (several % by weight-ten-odd % by weight) of carriers.

In the case of replenishing toner containing carriers, there are sometimes occasions wherein carrier particles enter a space between a seal member and a container main body, or a space between a seal member and a cap to lower sealing functions.

Entering of carrier can be prevented by causing seal member 60 to be interposed between step portion 13 and wall 27 which are made accurately, as explained earlier.

Meanwhile, for improving sealing functions, it is preferable to mount seal member 60 under the state of compression.

Figure 5:
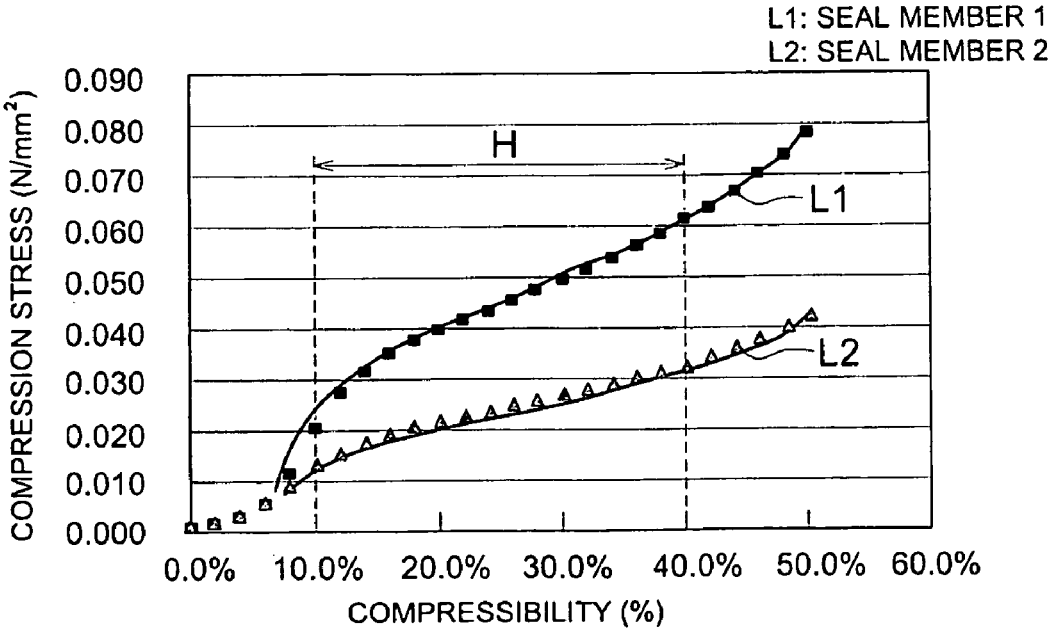
FIG. 5 is a graph showing changes of compression stress versus changes of compressibility of seal member 60.

FIG. 5 is a graph showing changes of compression stress for changes of compressibility of seal member 60.

When fluctuations of compression stress, namely, of drive force are great, a high-powered motor is needed to cover a range of fluctuations.

Therefore, there arise problems such as a large-sized apparatus, increased power consumption and high cost.

If compressibility is in a range of 10-40% shown with range H, it was confirmed by experiments that fluctuations of drive force are small, container main body 10 can be driven to rotate stably, and conditions for downsizing of an apparatus, power saving and for cost reduction can be satisfied.

It was possible to clear the condition of compressibility shown with range H in FIG. 5, by causing seal member 60 to touch face 13A of step portion 13 of container main body 10.

Urethane-foam is given as a preferable material to interpose between step portion 13 and wall 27, under the state of compression.

In the invention, a step portion is formed on a container main body, and a seal member is caused to interpose between the step portion and a cap.

Owing to the structure stated above, sealing function is improved, toner leakage is prevented sufficiently, toner can be ejected smoothly from a toner container and toner can be replenished accurately.

What is claimed is:

1. A toner container for replenishing toner to an image forming apparatus comprising:

a container main body which comprises a cylindrical toner storage section and a toner outlet, and has a cylindrical step portion at a lip portion of the toner outlet, the step portion comprising a cylindrical surface parallel to a rotation axis of the toner container and flange surface intersecting the cylindrical surface;

a cap that covers the toner outlet; and a seal member that is interposed between the container main body and the cap to prevent toner leakage, wherein the seal member is fixed on the cylindrical step portion to reside on the cylindrical surface and the flange surface such that the outer side of the cylindrical surface of the step portion provides radial support for the sealing member.

2. The toner container of claim 1, wherein the container main body is made by blow molding.

3. The toner container of claim 1, wherein when the cap is mounted on the container main body, the seal member interposed between the step portion and the cap is in a compressed state where compressibility of the seal member is 10%-40%.

4. The toner container of claim 1, wherein the storage section has a spiral projection protruded on an inside wall of the storage section, the container main body and the cap are capable of relative rotation, and the cap has a toner ejection section.

5. A toner replenishing method comprising:

ejecting the toner contained in a toner container through a cap by rotating a toner container main body; and replenishing the ejected toner into the image forming apparatus, wherein the toner container comprises:

a cylindrical toner storage section and a toner outlet, and has a cylindrical step portion at a lip portion of the toner outlet, the step portion comprising a cylindrical surface parallel to a rotation axis of the toner container and a flange surface intersecting the first cylindrical surface;

a cap that covers the toner outlet; and a seal member that is interposed between the container main body and the cap to prevent toner leakage, wherein the seal member is fixed on the cylindrical step portion to reside on the cylindrical surface and the flange surface such that the cylindrical surface of the step portion provides radial support for the sealing member.

6. A toner replenishing method of claim 5, wherein the storage section of the toner container has a spiral projection protruded on an inside wall of the storage section, the container main body and the cap are capable of relative rotation, and the cap has a toner ejection section.

7. The toner replenishing method of claim 6, wherein a volume average particle size of the toner is 3 μm-9 μm.

8. The toner replenishing method of claim 5, wherein a volume average particle size of the toner is 3 μm-9 μm.

* * * * *